US005596307A

United States Patent [19]

Hayashi et al.

[11] Patent Number: 5,596,307

[45] Date of Patent: Jan. 21, 1997

[54] THERMOSTAT

[75] Inventors: Toshiharu Hayashi; Akira Imoto, both of Osaka, Japan

[73] Assignee: Wako Electronics Company Limited, Osaka, Japan

[21] Appl. No.: 395,079

[22] Filed: Feb. 27, 1995

[30] Foreign Application Priority Data

Jun. 16, 1994 [JP] Japan ..... 6-159239

[51] Int. Cl.[6] ..... H01H 37/00

[52] U.S. Cl. ..... 337/298; 337/299

[58] Field of Search ..... 337/298, 299, 337/302, 318, 343, 365, 367

[56] References Cited

U.S. PATENT DOCUMENTS 3,662,311 5/1972 Snider et al. ..... 337/41

4,117,443 9/1978 Hofsass ..... 337/348

5,138,297 8/1992 Hollweck ..... 337/354

*Primary Examiner*—Lincoln Donovan

*Attorney, Agent, or Firm*—Lockwood, Alex, FitzGibbon & Cummings

[57] ABSTRACT

A thermostat consecutively comprising a temperature switch unit having a heat sensing element and switching contacts, and a forced reset unit having a plunger and a coil, in which a guide pin is disposed between the heat sensing element and switching contacts, a reset shaft capable of abutting against the switching contacts is provided in the temperature switch unit, and the plunger and reset shaft are moved by energizing the coil, thereby resetting the switching contacts in ON state.

7 Claims, 14 Drawing Sheets

FIG. 3(a)
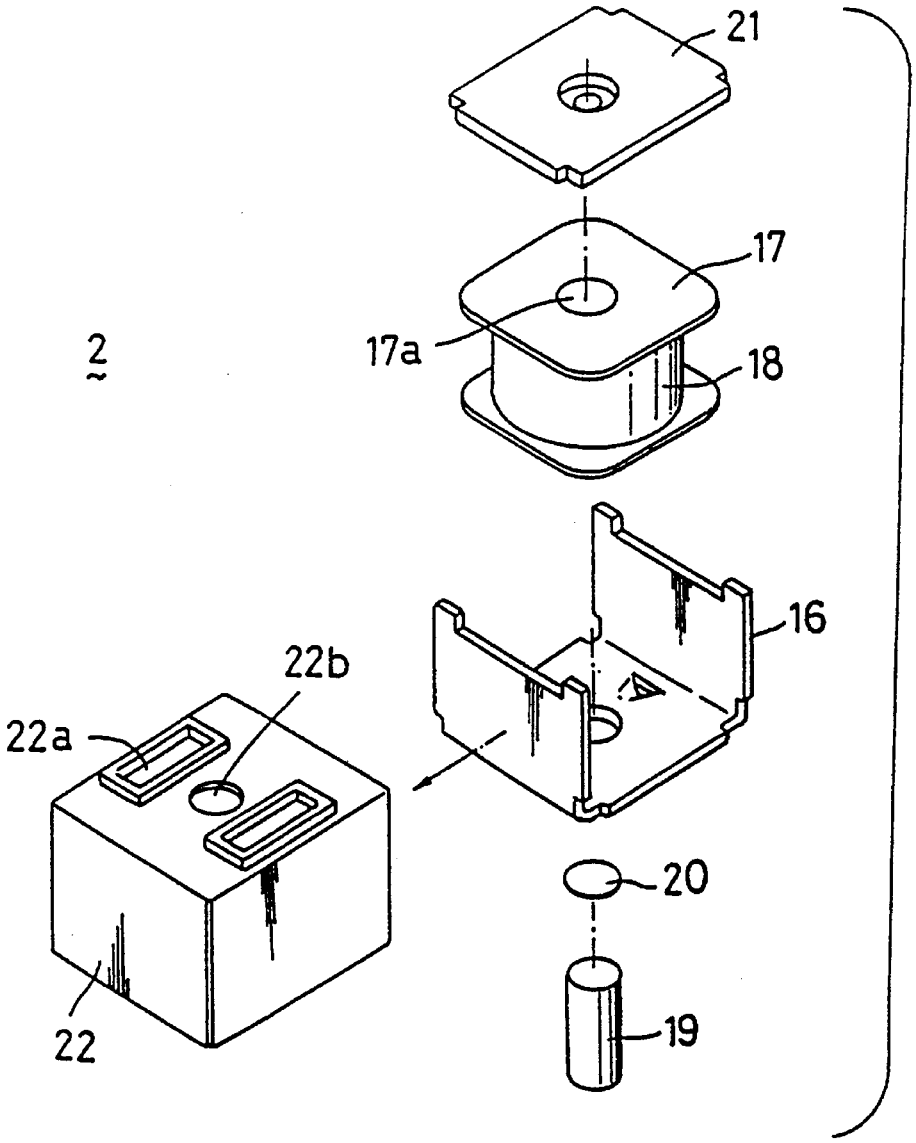
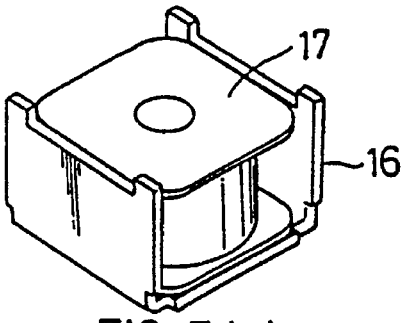
FIG. 3(b)
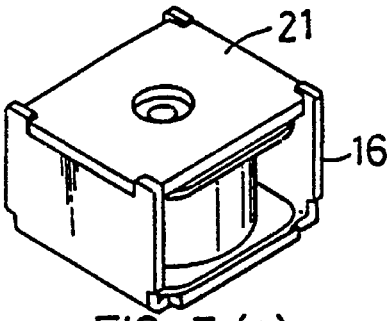
FIG. 3(c)

THERMOSTAT

BACKGROUND OF THE INVENTION

1. Field of the Invention

The present invention relates to a thermostat capable of resetting a switching contact of the thermostat to initial state by force by remote control operation, and a heating apparatus using this thermostat.

2. Description of the Related Art

A thermostat is an electric part for on/off control of a switching contact by sensing the ambient temperature, and changes of ambient temperature are sensed by a heat sensing element (a bimetal disk). The heating sensing element is displaced in its curvature state when its temperature exceeds a first set temperature, and later returns to the initial curvature state when the temperature of the heat sensing element drops below a second set temperature, and the on/off state of the switch contact is shifted by making use of this property.

The thermostats are classified into the automatic reset type thermostat which is automatically reset to the initial state in the usual operating state of the apparatus in which the thermostat is incorporated (that is, in normal state), and the manual reset type thermostat which is not reset to the initial state in normal state unless manipulated by man.

In the automatic reset type thermostat, when the temperature of the heat sensing element exceeds the first set temperature, the switching contact is changed, for example, from ON state to OFF sate, and then when becoming lower than the second set temperature (automatic reset temperature), the thermostat automatically returns to the initial ON state, and typically it is used for the purpose of maintaining the apparatus comprising the thermostat within a specified temperature range.

In the manual reset type thermostat, on the other hand, once the switching contact is changed, for example, from ON state to OFF state when the temperature of the heat sensing element exceeds the first set temperature, in the usual operating state of the apparatus, it is held in the OFF state unless manipulated by man. Keeping the switching contact in OFF state is useful for preventing recurrence of abnormal state, and it is achieved, for example, by setting the automatic reset temperature of the bimetal disk below the ordinary temperature (for example, −30° C.).

FIG. 18 shows a manual reset type thermostat having the automatic reset temperature of bimetal disk set below ordinary temperature. In this manual reset type thermostat 70, once a bimetal disk 71 is displaced physically, it is not reset automatically to the initial state in normal state. If necessary, hence, a guide pin 73 is pushed up by a reset button 72 to return the bimetal disk 71 to the initial state (the shown state).

However, the manual reset type thermostat as shown in FIG. 18 is very inconvenient because the mounting position is limited.

For example, suppose to incorporate the manual reset type thermostat 70 in a cooking utensil 74 as shown in FIG. 19. The cooking utensil 74 comprises a heater 75, a cooking unit 76 heated by the heater 75, and a case 77 housing the heater 75 and cooking unit 76, but in this cooking utensil, since the place A suited for the user to manipulate the reset button 72 and the place suited for the bimetal disk 71 for sensing the heat are not matched, the thermostat 70 is installed in an intermediate position, which makes it very inconvenient to use.

Incidentally, it may be considered to manipulate the reset button 72 from a remote plate by making use of leverage or the like, but the entire mechanism is complicated, and it is difficult to assemble the apparatus, which is not regarded as a reasonable means of solving the problem.

The invention is devised to solve the problem and it is a primary object thereof to present a thermostat for remote control operation capable of installing the heat sensing element in an appropriate position, and manipulating to reset at an arbitrary position.

SUMMARY OF THE INVENTION

To achieve the object, the invention provides a thermostat consecutively comprising a temperature switch unit for varying the opening state of switching contacts by physical dislocation of a heat sensing element, and a forced reset unit for resetting the switching contacts by force to the initial state, wherein one of the switching contacts is formed in part of a spring member, and between the heat sensing element and spring member is provided a transmission member for transmitting displacement to the spring member, when the heat sensing element is displaced from the initial state, to vary the opening state of the switching contacts, a reset shaft of a proper length for abutting against the spring member is inserted into the temperature switch unit so as to be free to move back and forth from the opposite side of the heat sensing element, the forced reset unit is provided at least with a bobbin having a central penetration hole, a coil wound on this bobbin, and a magnetic movable member to be inserted into the central penetration hole, and the coil is energized to move the movable member, thereby resetting the switching contacts by force to the initial state.

The thermostat of the invention is composed by consecutively disposing the temperature switch unit and forced reset unit, and as the movable member provided in the forced reset unit is operated by remote control, the switching contact is reset to the initial state. Therefore, this thermostat may be disposed at an appropriate place, and can be operated by remote control from an appropriate place.

BRIEF DESCRIPTION OF THE SEVERAL VIEWS OF THE DRAWINGS

FIG. 3*a* is an exploded view of a forced reset unit 2.

FIG. 3*b* shows a bobbin 17 accommodated in a yoke 16.

FIG. 3*c* shows a yoke lid 21 put on a top surface of the yoke 16.

FIG. 6*a*(2) shows a different microswitch spring.

DETAILED DESCRIPTION OF THE PREFERRED EMBODIMENTS

Figure 1:
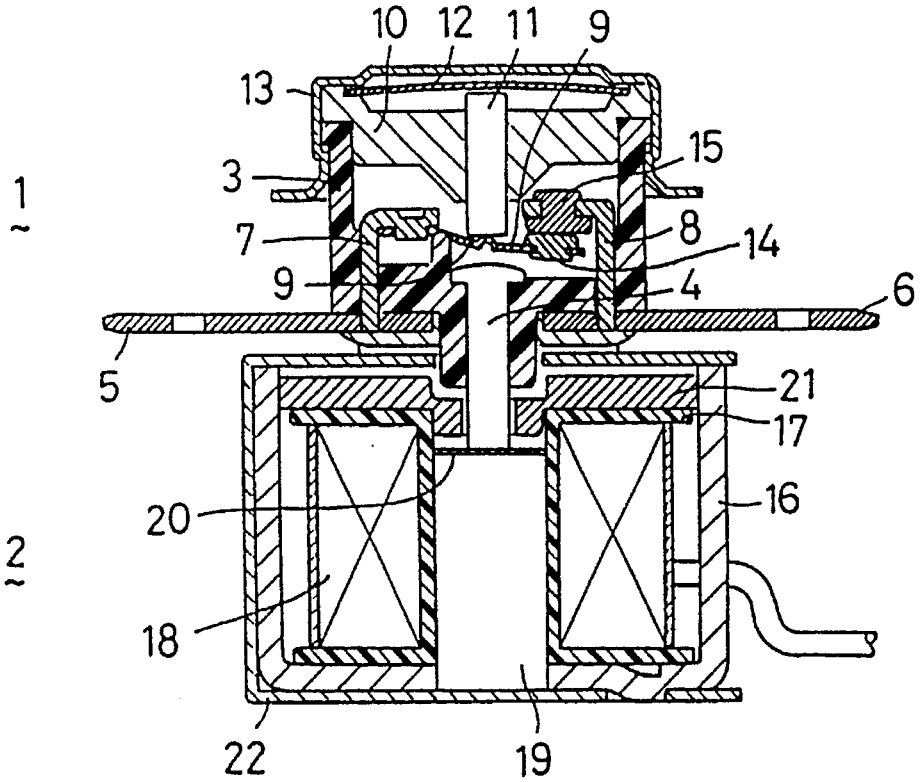
FIG. 1*a* is a sectional view of a thermostat according to the invention.
FIG. 1*b* is a perspective diagram of a thermostat according to the invention.
Figure 1:
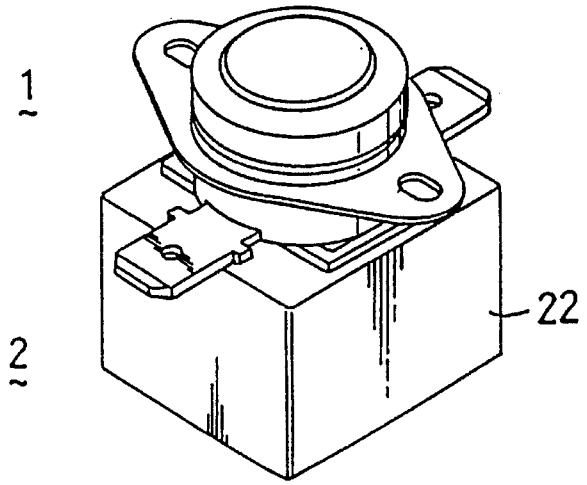

FIG. 1 shows a sectional view (a) and a perspective view (b) of a thermostat for remote control operation in an embodiment of the invention.

This thermostat is composed by consecutively disposing a temperature switch unit 1 for on/off control of a switching contact by physical displacement of a heat sensing element, and a forced reset unit 2 which resets the switching contact and heat sensing element by force into the initial state. For the convenience of description, the thermostat is a manual reset type thermostat, but the constitution is the same in the case of a manual reset type thermostat.

Figure 2:
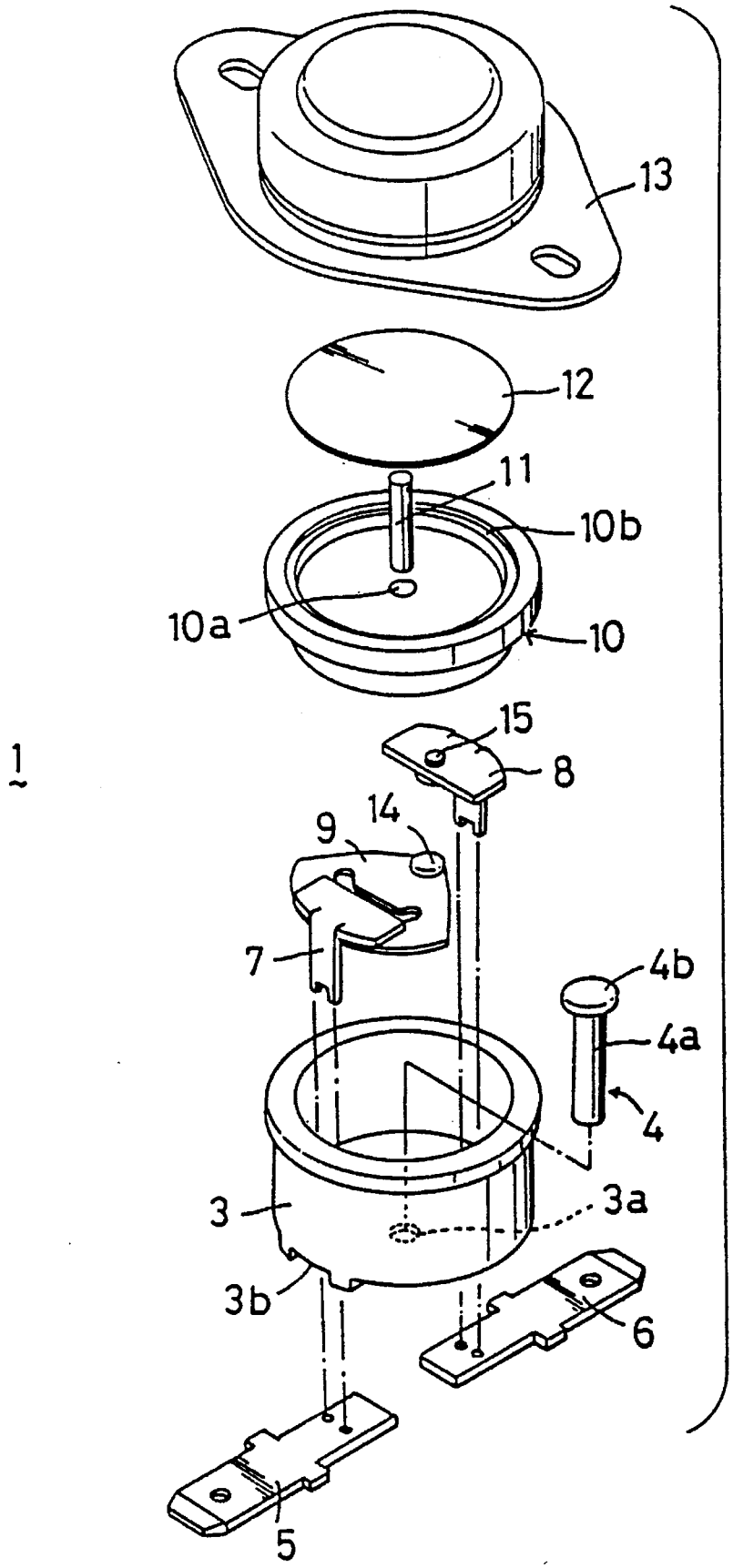
FIG. 2 is an exploded view of a temperature switch unit 1.

As shown in FIG. 1 and FIG. 2, the temperature switch unit 1 is composed of a base pat 3 composed in a cylindrical form with a bottom, a reset shaft 4 inserted into a bottom hole 3*a* of the base part 3, connecting terminals 5, 6 affixed to an outer bottom 3*b* of the base part 3, a first fitting 7 soldered to the connecting terminal 5 by penetrating through the bottom of the base part 3, a second fitting 8 soldered to the connecting terminal 6 by penetrating through the bottom of the base part 3, a contact spring 9 affixed to the first fitting 7, a middle lid 10 of disk form to cover the contact spring 9 and others from above, a guide pin 11 inserted into a central hole 10*a* of the middle lid 10, a heat sensing element 12 of disk form held in a peripheral edge 10*b* of the middle lid 10, and a cap 13 for covering the heat sensing element 12 from above to fix the middle lid 10 and base part 3. A switching contact is formed by a movable contact 14 provided at the front end of the contact spring 9, and a fixed contact 14 provided in the second fitting 8.

The reset shaft 4 has its main body 4*a* formed in a slightly smaller diameter than the bottom hole 3*a* of the base part 3, and the head 4*b* in a larger diameter than the bottom hole 3*a* of the base part 3. Therefore, the reset shaft 4 will not slip out of the bottom hole 3*a* of the base part 3, and is free to move back and forth in the bottom hole 3*a*.

The heat sensing element 12 is designed to be displaced physically depending on the ambient temperature, and is curved in a downward convex form when the ambient temperature reaches a specific temperature. In this embodiment, the automatic reset temperature of the heat sensing element 12 is set below an ordinary temperature, and once curved in a downward convex form, the heat sensing element will not be reset automatically to the initial state in normal condition.

The axial length of the guide pin 11 is formed slightly shorter than the interval between the heat sensing element 12 curved in an upward convex form and the contact spring 9. Therefore, while the heat sensing element 12 is curved in an upward convex form, the switching contacts 14, 15 are in ON state by the thrusting force of the contact spring 9, but when the heat sensing element 12 is curved in a downward convex form, its displacement is transmitted to the contact spring 9 by the guide pin 11, and the switching contacts 14, 15 are changed to OFF state. Regardless of the subsequent temperature drop, the switching contacts 14, 15 are maintained in OFF state in normal condition.

As shown in FIG. 1 and FIG. 3, the forced reset unit 2 is composed of a yoke 16 with a pi-section, a bobbin 17 accommodated in the yoke 16, a coil 18 wound around the bobbin 17, a plunger 19 inserted into the central hole 17*a* of the bobbin 17, a film 20 covering the top end of the plunger 19, a yoke lid 21 put on the top surface of the yoke 16, and a case 22 accommodating the members 16 to 21. The forced reset unit 2 and the temperature switch unit 1 are adhered into one body with resin or the like at a junction 22*a* on the top surface of the case 22. In the assembled state of the temperature switch unit 1 and forced reset unit 2, the reset shaft 4 of the temperature switch unit 1 is inserted into the opening 22*b* of the case 22, and contacts with the plunger 19 through the film 20.

In thus constituted thermostat, the operation is described below while referring to FIG. 1 and FIG. 4.

In the initial state, the heat sensing element 12 is curved in an upward convex form, the switching contacts 14, 15 are in ON state, and the coil 18 is not energized (FIG. 1(*a*)). Afterwards, when the ambient temperature climbs up and the temperature of the heat sensing element 12 exceeds a first set temperature, the heat sensing element 12 is curved in a downward convex form to move the guide pin 11 downward. Consequently, the guide pin 11 pushes the contact spring 9, and the switching contacts 14, 15 are changed from ON state to OFF state (FIG. 4(*a*)). Then, if the ambient temperature of the heat sensing element 12 is lowered, the curved state of the heat sensing element 12 is not changed in normal condition, and hence the switching contacts 14, 15 are maintained in OFF state. .

Figure 4A:
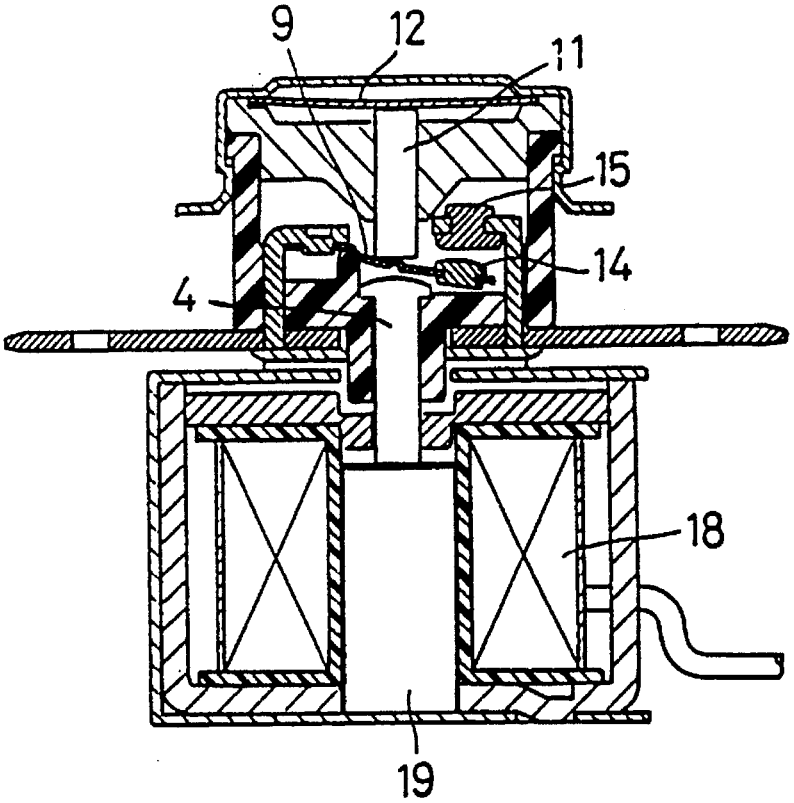
FIG. 4*a* shows OFF state of a temperature switch unit 1.
Figure 4B:
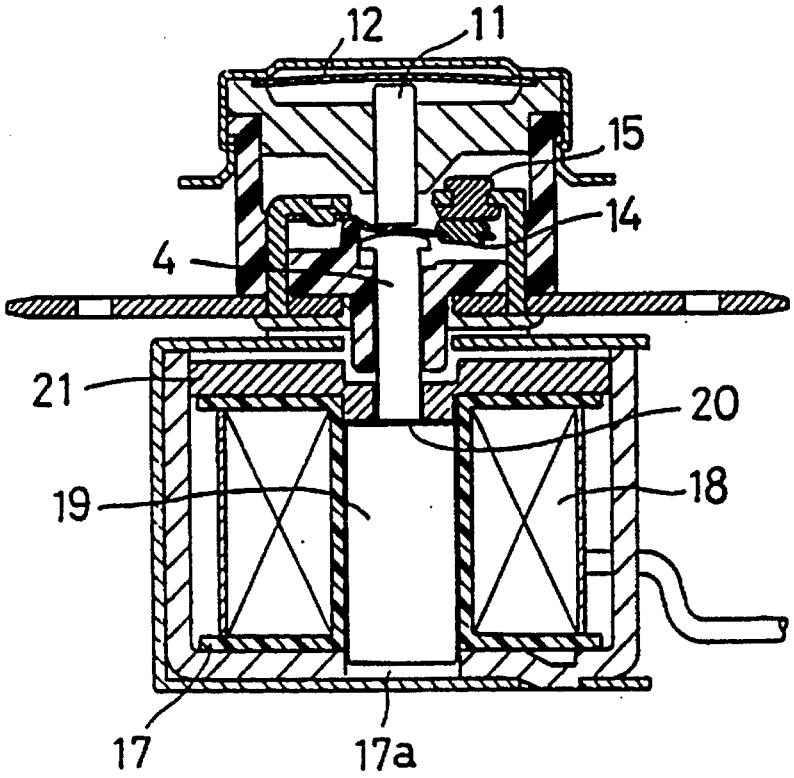
FIG. 4*b* shows ON state of temperature switch unit 1.

To reset the thermostat remaining in the state of FIG. 4(*a*) into the initial state, electric power is supplied to the coil 18 of the forced reset unit 2. As a result, the plunger 19 is moved upward by the magnetic field formed in the central hole 17*a* of the bobbin 17. and hence the reset shaft 4 is also moved upward. The reset shaft 4 moving upward abuts against the contact spring 9 to push up the guide pin 11, thereby changing the switching contacts 14, 15 into ON state, while the curved state of the heat sensing element 12 is reset o an upward convex form (FIG. 4(*b*)). Later, when power supply to the coil 18 is stopped, the reset shaft 4 and plunger 19 move to the lower side to return to the state of FIG. 1(*a*). Meanwhile, since the film 20 is provided between the reset shaft 4 and plunger 19, if the yoke lid 21 is magnetized by the effect of residual magnetism or the like, the yoke lid 21 and plunger 19 are not magnetically attracted. After stopping power supply to the coil 18, if the plunger 19 is magnetically attracted to the yoke lid 21, the operating temperature of the heat sensing element 12 may be deviated by the magnetic attracting force, but such problem is avoided.

The operation of manual reset type thermostat is explained herein, and in the case of automatic reset type thermostat, the switching contacts may be reset by force to the initial state by operating the forced reset unit before the displacement of the heat sensing element is reset automatically.

Figure 5:
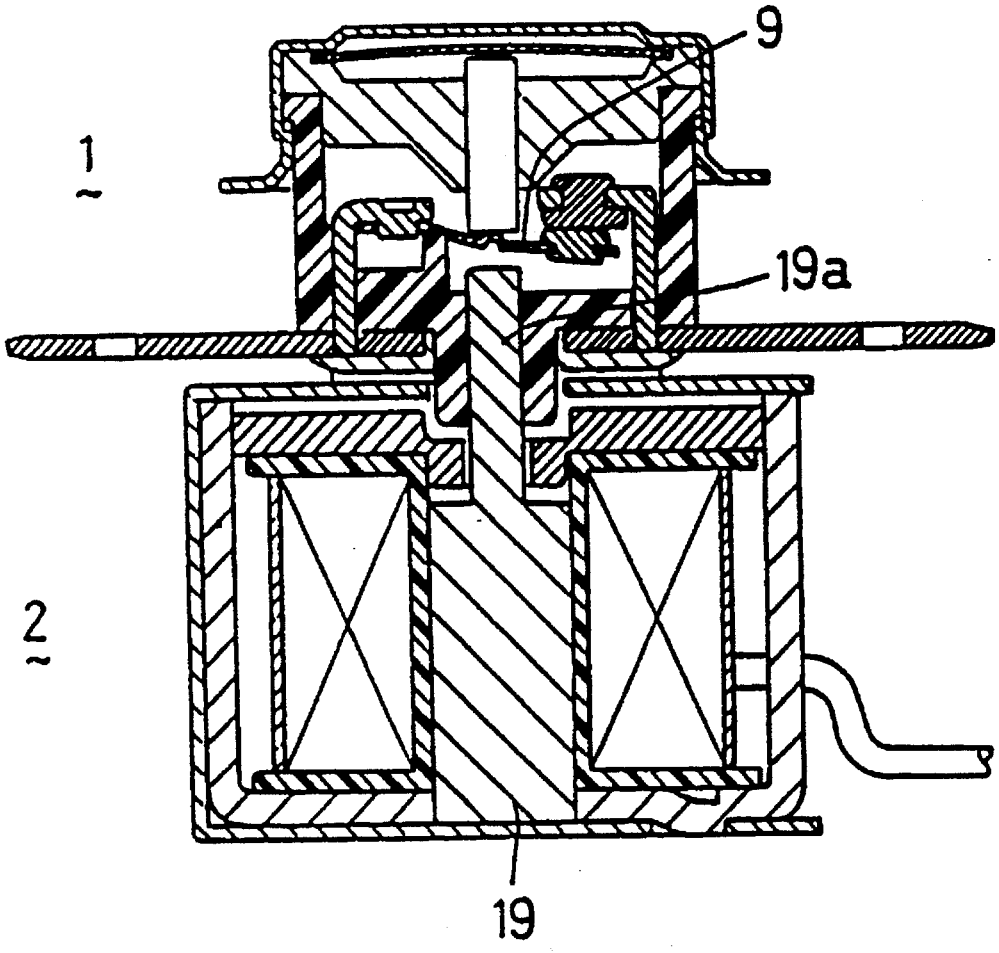
FIG. 5 shows another embodiment partly modifying FIG. 1*a*.

In FIG. 1, the reset shaft 4 and plunger 19 are separate, but the plunger 19 and reset shaft 4 may be formed also into one body as shown in FIG. 5. In this case, the front end 19*a* of the plunger 19 is inserted into the temperature switch unit 1, and is brought into contact with the contact spring 9 when the coil 18 is energized. Therefore, the operation is same as in the case of the thermostat in FIG. 1.

In the explanation of FIG. 1 and FIG. 5, the OFF state of the switching contacts is held by using the heat sensing element that is not reset automatically in normal condition, but it is not limited, and the OFF state of the switching contact may be held by other mechanism than the heat sensing element by using the heat sensing element that is reset automatically in normal condition (see FIG. 6 to FIG. 9).

Figure 6A:
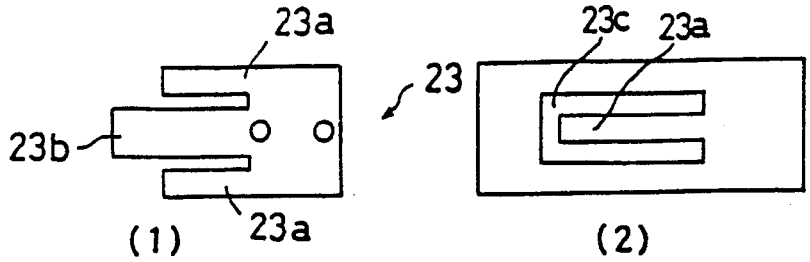
FIG. 6*a*(1) shows a microswitch spring.
Figure 6B:
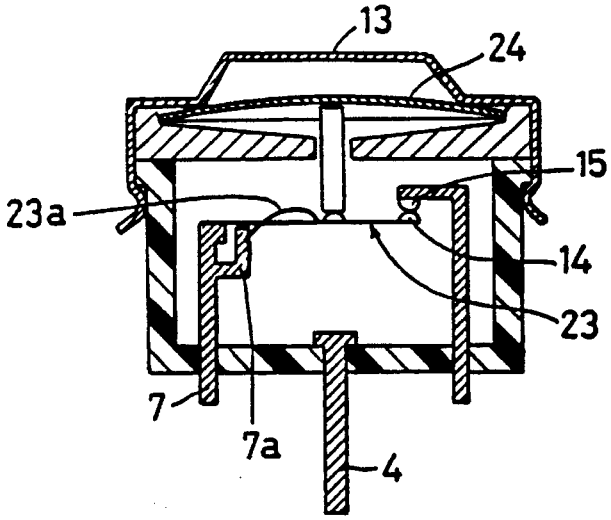
FIG. 6*b* shows a different embodiment of a temperature switch unit 1.
Figure 6C:
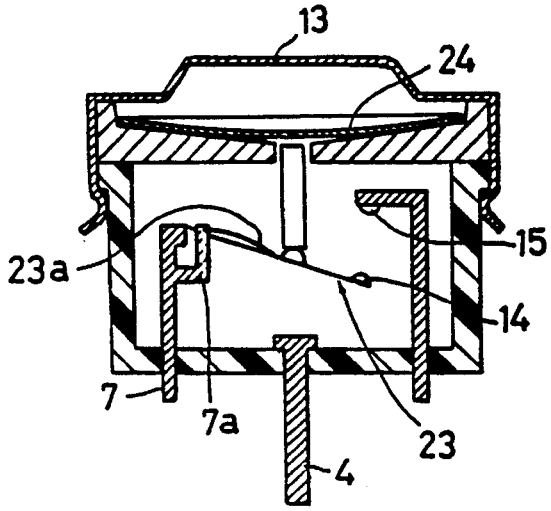
FIG. 6*c* shows OFF state of a switch unit 1 of FIG. 6*b*.

In FIG. 6, the OFF state of the switching contacts 14, 15 is maintained by using a microswitch spring 23. The microswitch spring 23 comprises a hook 23*a* and a main body 23*b* as shown in FIG. 6(*a*) A, and the hook 23*a* is curved, and its front end is stopped in a stopping part 7*a* of the first fitting 7. Accordingly, in the initial state in FIG. 6(*b*), the microswitch spring 23 is thrust upward, but when lowered to the state in FIG. 6(*c*), the microswitch spring 23 is thrust downward. Or, the microswitch spring 23 may be of the type having a notch 23*c* around the hook 23*a* (FIG. 6(*a*) B), and in this case, too, the hook 23*a* is stopped in the stopping part 7*a* of the first fitting 7.

In this embodiment, since the heat sensing element 24 is set so as to be reset automatically in normal condition, after the heat sensing element 24 is curved in a downward convex form from the initial state in FIG. 6(*b*), when the ambient temperature is lowered to the automatic reset temperature, the heat sensing element 24 is automatically reset to an upward convex form. However, since the microswitch spring 23 is thrust downward, the OFF state of the switching contacts 14, 15 is maintained unless the microswitch spring 23 is displaced to the initial state by pushing up the reset shaft 4 by force. To return the switching contacts 14, 15 to ON state, the reset shaft 4 must be moved upward, and it is enough with the force for displacing the microswitch spring 23, and it is not necessary to reset the curved state of the heat sensing element, so that a smaller force is required to be applied to the reset shaft 4.

Figure 7A:
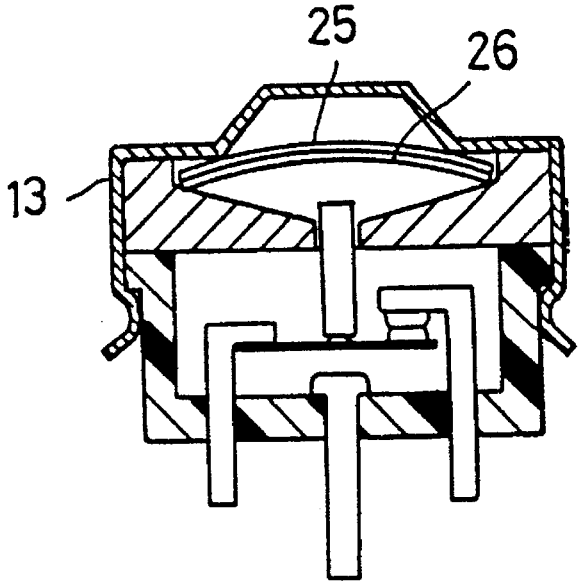
FIG. 7*a* shows a different embodiment of a temperature switch unit 1.
Figure 7B:
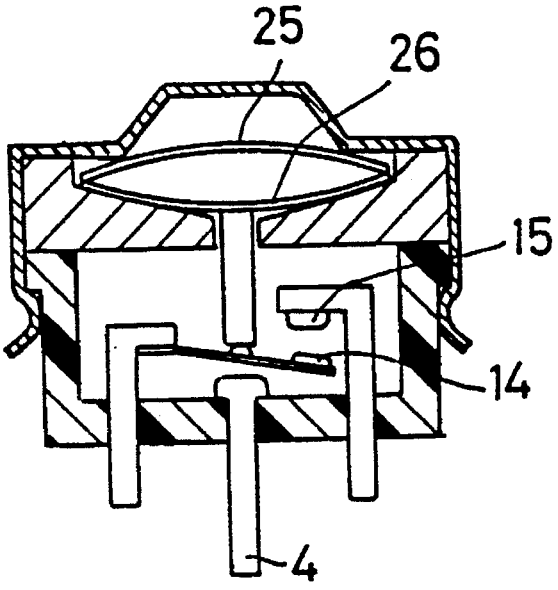
FIG. 7*b* shows OFF state of a switch unit 1 of FIG. 7*a*.

FIG. 7 shows an embodiment of thermostat of disk overlaying method. This thermostat is composed by overlaying a heat sensing element 25 which is reset automatically in normal condition, and a disk 26 curved and deformed arbitrarily in upward and downward convex forms with a relatively weak force. When the ambient temperature increases, the heat sensing element 25 is displaced from the initial state of FIG. 7(*a*), and is curved in a downward convex form. Accordingly, along with the curvature of the heat sensing element 25, the disk 26 is also curved in a downward convex form, and the switching contacts 14, 15 are changed to OFF state. Afterwards, when the ambient temperature drops to reach the automatic reset temperature, the heat sensing element 24 is reset in an upward convex form, but the disk 26 remains curved in a downward convex form, and therefore the OFF state of the switching contacts 14, 15 is maintained (FIG. 7(*b*)). When the disk 26 is reset in an upward convex form by pushing up the reset shaft 4, the switching contacts 14, 15 are reset to ON state, but the disk 26 is easily reset to an upward convex form, so that only a small force is enough to be applied to the reset shaft 4.

Figure 8A:
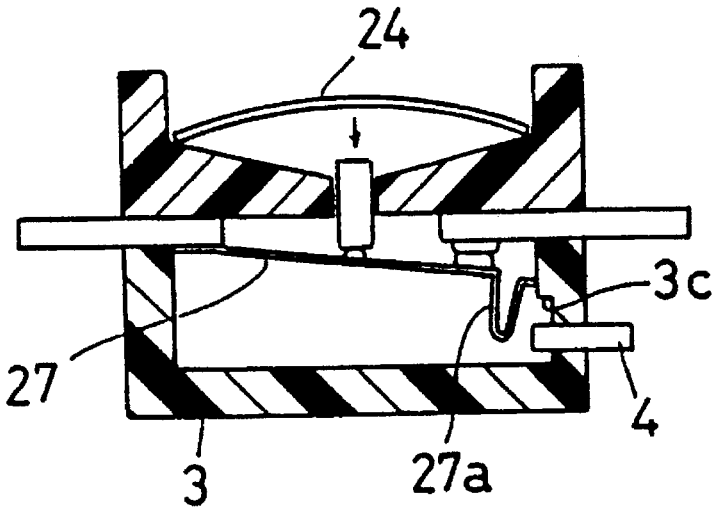
FIG. 8*a* shows a different embodiment of a temperature switch unit 1.
Figure 8B:
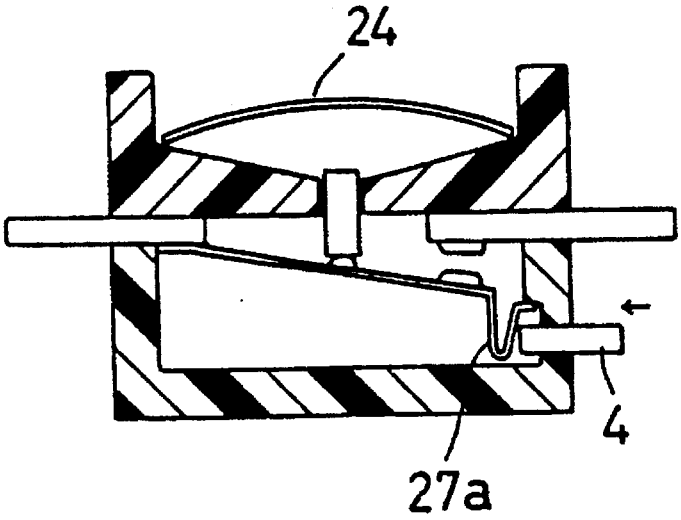
FIG. 8*b* shows OFF state of a switch unit 1 of FIG. 8*a*.
Figure 9A:
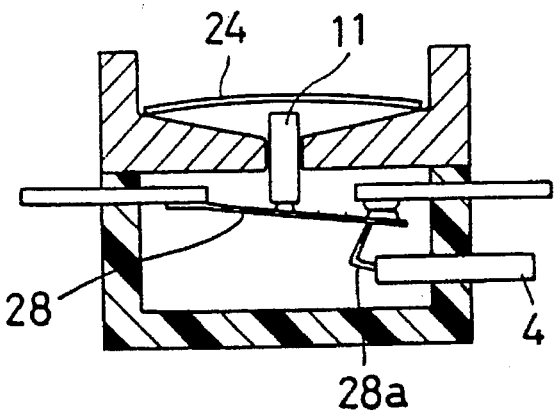
FIG. 9*a* shows a different embodiment of a temperature switch unit 1 with a heating element 24 in its initial curvature state.
Figure 9B:
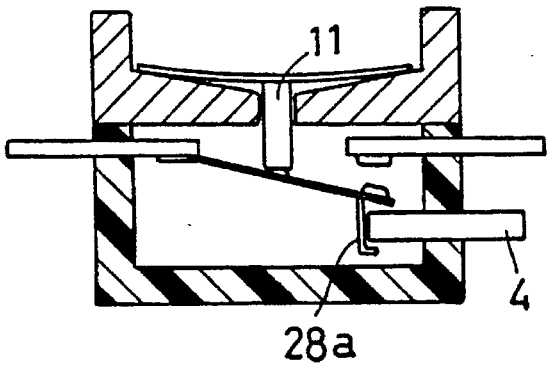
FIG. 9*b* shows the heating element displaced in its curvature state.
Figure 9C:
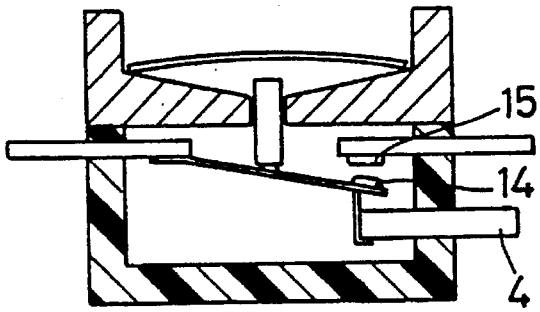
FIG. 9*c* shows the heating element returned to the initial curvature state.
Figure 9D:
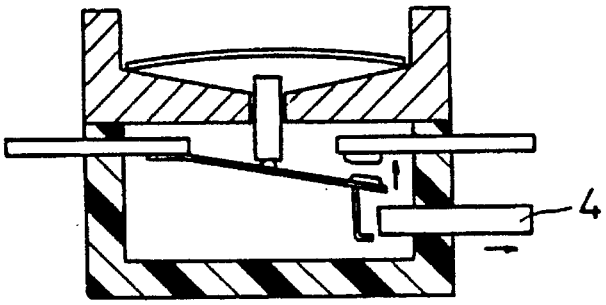
FIG. 9*d* shows a reset shaft 4 moving in the right direction.

FIG. 8 shows a different embodiment, in which a stopping part 27*a* is provided at the front end of a leaf spring 27, the stopping part 17*a* is hooked in a stopping step 3*c* of the base part 3, and the OFF state of the switching contacts 14, 15 is maintained. Incidentally, FIG. 8 is a schematic diagram for explaining the operation, and hence cap 13 and others are omitted.

Since the stopping part 27*a* is thrust so s to spread to the right direction in FIG. 8, when the ambient temperature climbs up and the heat sensing element 24 is curved in a downward convex form to move the leaf spring 27 downward, the stopping pat 27*a* is hooked in the stopping step 3*c*. Accordingly, if the ambient temperature drops and the heat sensing element 24 is reset in an upward convex form, the OFF state of the switching contacts 14, 15 is maintained by the engagement of the stopping part 27*a* and stopping step 3*c* (FIG. 8(*b*)). When the reset shaft 4 is moved to the left, the engagement of the stopping part 27*a* and stopping step 3*c* is cleared, thereby returning to the initial state (FIG. 8(*a*)) in which the switching contacts 14, 15 are in ON state.

FIG. 9 is a schematic diagram for explaining the operation of a further different embodiment, in which the base part 3 does not have stopping step 3*c*, but the reset shaft 4 plays the role of a stopper. In this embodiment, since a hook 28*a* is provided at the front end of the leaf spring 28, when the heating element 24 is curved in a downward convex form to move the guide pin 11, the hook 28*a* is hooked on the reset shaft 4 (FIG. 9(*b*)). Accordingly, if the ambient temperature is later lowered and the heat sensing element 24 is reset to an upward convex form, the switching contacts 14, 15 are maintained in OFF state (FIG. 9(*c*)). When the reset shaft 4 is moved to the right direction, the engagement of the hook 28 and reset shaft 4 is cleared, and the switching contacts 14, 15 are reset to ON state (FIG. 9(*d*)).

In FIG. 6 to FIG. 9, the reset shaft 4 of the temperature switch unit 1 is moved back and forth by the forced reset unit 2 shown in FIG. 1 or FIG. 5, but it is not limitative, and it may be also composed to move back and forth by other forced reset unit 2 mentioned below (FIG. 10 to FIG. 13).

Figure 10:
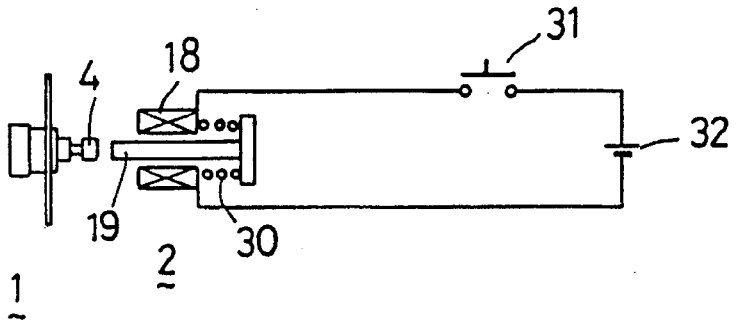
FIG. 10 shows a different embodiment of a forced reset unit 2.

The forced reset unit 2 of the thermostat shown in FIG. 10 is composed of a coil 18 wound on a bobbin, a plunger 19 inserted into the central hole of the bobbin, and a spring 30 for thrusting the plunger 19 in the rightward direction. The coil 18 is connected to a direct-current power source 32 through a reset switch 31. In this embodiment, since the plunger 19 is thrust in the rightward direction, while the coil 18 is not energized, the reset shaft 4 of the temperature switch unit 1 and the plunger 19 of the forced reset unit 2 are always separated. Therefore, regardless of the weight of the plunger 19, there is no restriction on the configuration of the temperature switch unit 1 and forced reset unit 2.

Figure 11A:
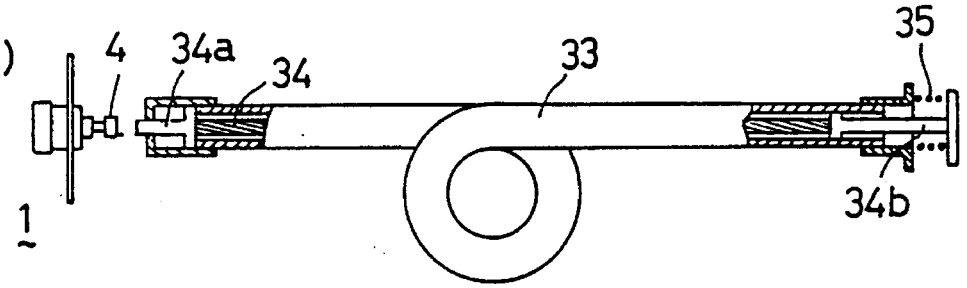
FIG. 11*a* shows a different embodiment of a forced reset unit 2.
Figure 11B:
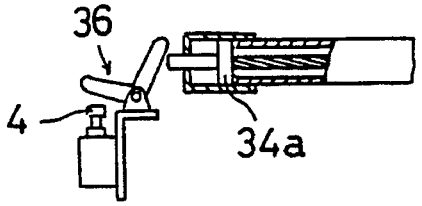
FIG. 11*b* shows a different embodiment of a forced reset unit 2.

FIG. 11 shows an embodiment of composing a forced reset unit 2 by a remote control operation mechanism used in release of camera or the like. The forced reset unit 2 comprises a flexible tube 33 which can be deformed, a flexible core 34 which moves freely back and forth in the flexible tube 33, a first transmission piece 34*a* which transmits the motion of the flexible core 34 to the temperature switch unit 1, a second transmission piece 34*b* to be manipulated by hand, and a spring 35 disposed between the flexible tube 33 and second transmission piece 34*b*. In the case of the thermostat in FIG. 11, by pushing the second transmission piece 34*b* to the left direction, the first transmission piece 34*a* abuts against the reset shaft 4 of the temperature switch unit 1, thereby resetting the curved state of the heat sensing element to the initial state. If the flexible core 34 and reset shaft 4 are not on a straight line, a direction changing mechanism 36 may be provided as shown in FIG. 11(*b*).

The forced reset unit 2 shown in FIG. 2 comprises a flexible tube 37, cylinders 38*a*, 38*b* provided at both ends of the flexible tube 37, a piston 39*a* moving in the cylinder 38*a*, a piston 39*b* of operation side moving in the cylinder 38*b*, and a spring 40 disposed between the piston 39*b* and cylinder 38*b*. The flexible tube 37 is filled with air or oil.

Figure 12A:
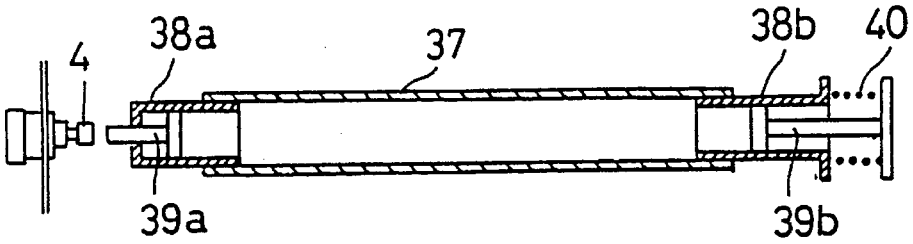
FIG. 12*a* shows a different embodiment of a force reset unit 2.
Figure 12B:
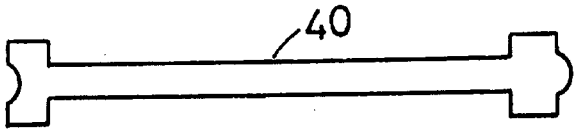
FIG. 12*b* shows a rubber bellow 40.
Figure 12C:
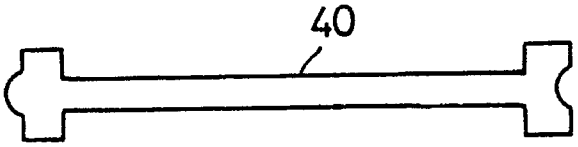
FIG. 12*c* shows a rubber bellow 40.

In the case of the forced reset unit 2 shown in FIG. 12, when the piston 39*b* is pushed to the left, the piston 39*a* moves to the left and the reset shaft 4 of the temperature switch unit 1 is pushed to the left, thereby resetting the curved state of the heat sensing element to the initial state. Instead of the cylinder, it may be also possible to use rubber bellows 40 which may be deformed as shown in FIG. 12(*b*) and (*c*) depending on the move of the piston 39*b*.

Figure 13:
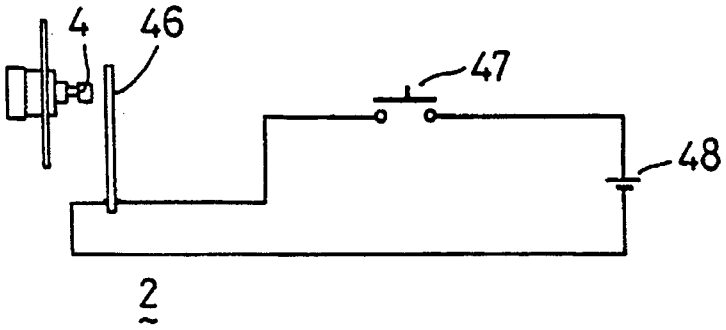
FIG. 13 shows a different embodiment of a forced reset unit 2.

FIG. 13 shows an embodiment of composing the forced reset unit 2 by means of a piezoelectric actuator 46. In this forced reset unit 2, by energizing the piezoelectric actuator 46, the reset shaft 4 of the temperature switch unit 1 is moved to the left, and the piezoelectric actuator may be of laminate type, aside from the bimorph type shown in the drawing. The piezoelectric actuator 46 is driven by a direct-current power source 48 through a reset switch 47.

A heating apparatus by using the thermostat for remote control operation of the invention is described below.

Figure 14:
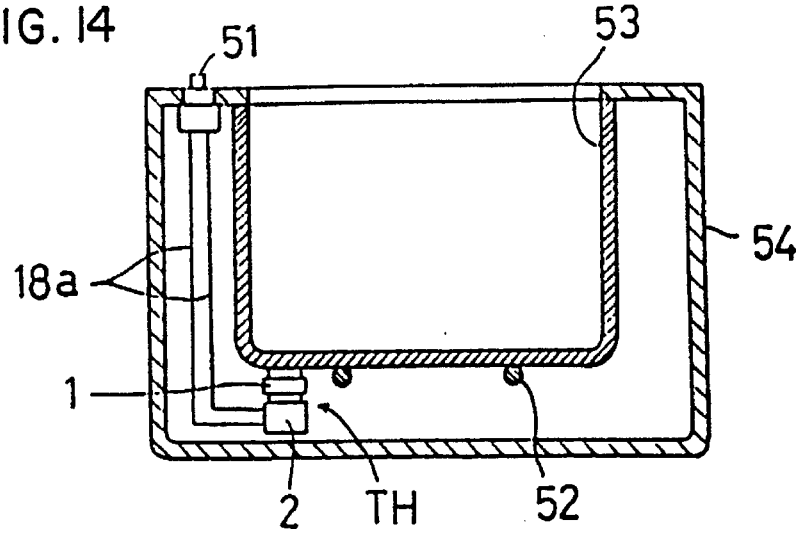
FIG. 14 shows a heating apparatus using the thermostat of the invention.

FIG. 14 shows a case of applying the thermostat TH shown in FIG. 1 into a heating apparatus, in which the thermostat TH is reset by force to the initial state by manipulation of a reset switch 51. The thermostat TH and reset switch 51 are connected with a lead wire 18*a*.

This heating apparatus comprises a heater 52, a cooking unit 53 heated by the heater 42, and a case 54 accommodating the heater 52 and cooking unit 53. Herein, the thermostat TH is installed in a position most suited to thermal sensing, adjacently to the heater 52, while the reset switch 51 is provided at a place most convenient for the user to manipulate.

Figure 15:
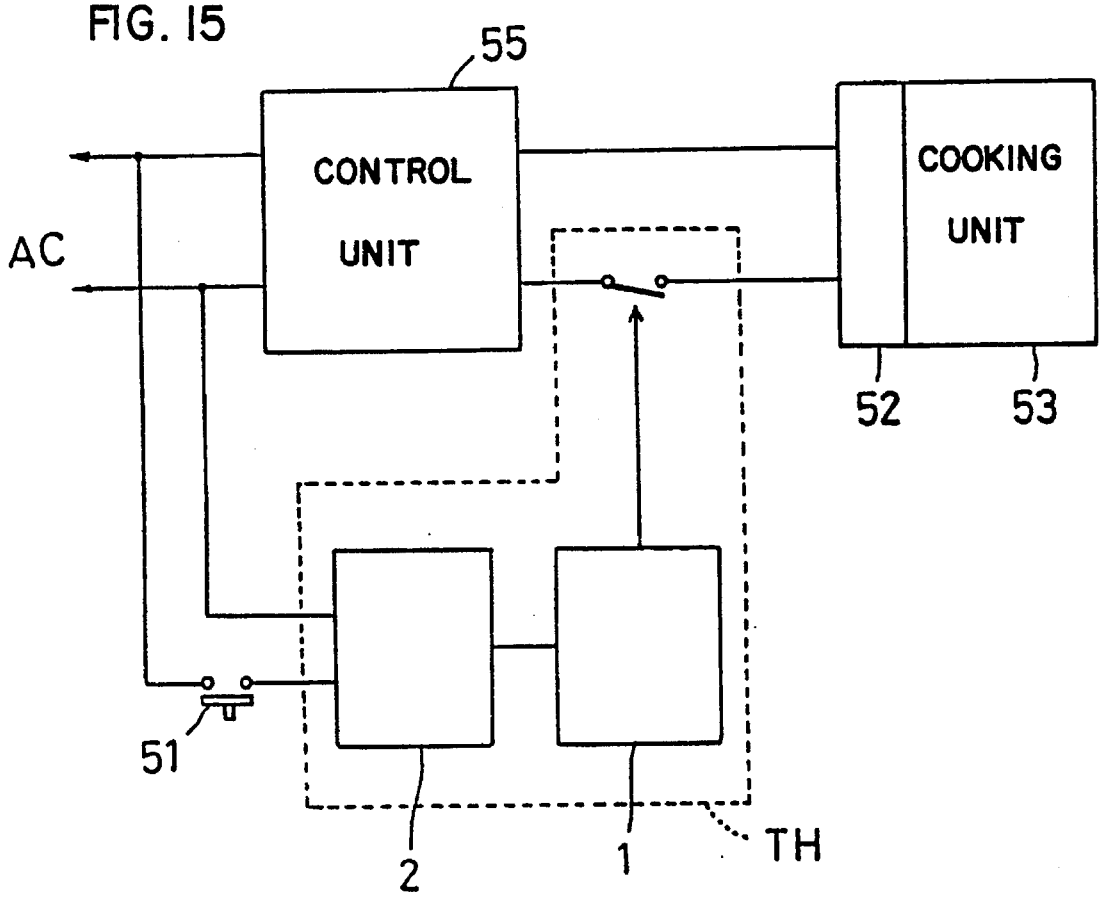
FIG. 15 is a block diagram showing the heating apparatus of FIG. 14.

FIG. 15 is a circuit block diagram of the heating apparatus in FIG. 14. As shown in the diagram, the switching contacts 14, 15 of the thermostat TH are provided to offer on/off control of connection of the control unit 55 and heater 52, and an alternating-current power source AC is supplied to the coil 18 of the forced reset unit 2 through the reset switch 51. In this heating apparatus, the cooking unit 53 is heated as being controlled by the control unit 55, but the temperature of the cooking unit 53 may reach an abnormally high temperature due to certain circumstances. In such a case, the heat sensing element of the temperature switch unit 1 is curved and displaced, and the switching contacts 14, 15 are changed to OFF state to stop driving of the heater 52. If the temperature is lowered afterwards, the OFF state of the switching contacts 14, 15 is maintained, and when the cause of abnormality is removed and the reset switch 51 is manipulated, the forced reset switch 2 operates to set the switching contacts 14, 15 in ON state, thereby resuming driving of the heater 52. In this explanation, the thermostat shown in FIG. 1 is mentioned, but it is not limitative, and the temperature switch unit 1 in FIG. 5 to FIG. 9 may be properly combined with the forced reset unit 2 in FIG. 10 to FIG. 13.

Figure 16:
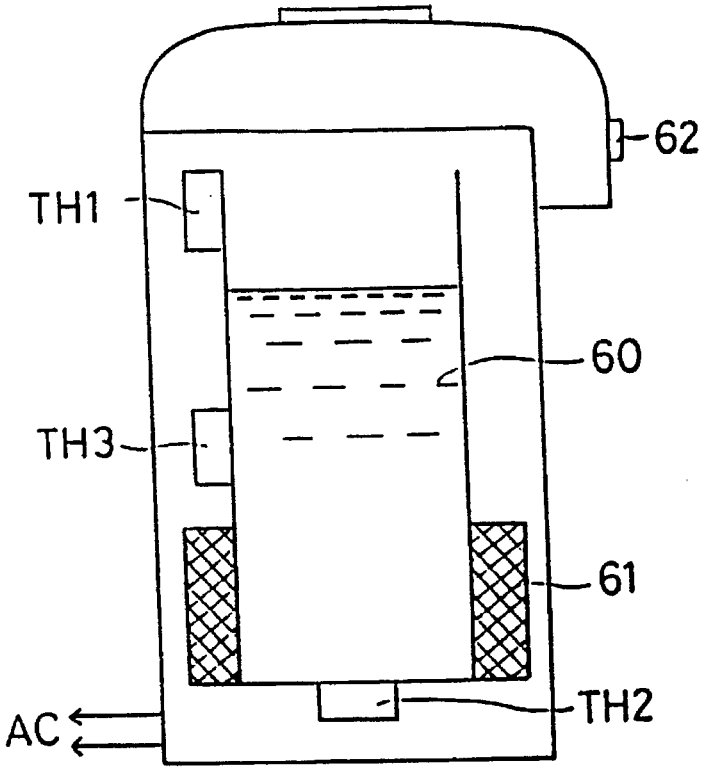
FIG. 16 shows other heating apparatus using the thermostat of the invention.
Figure 17:
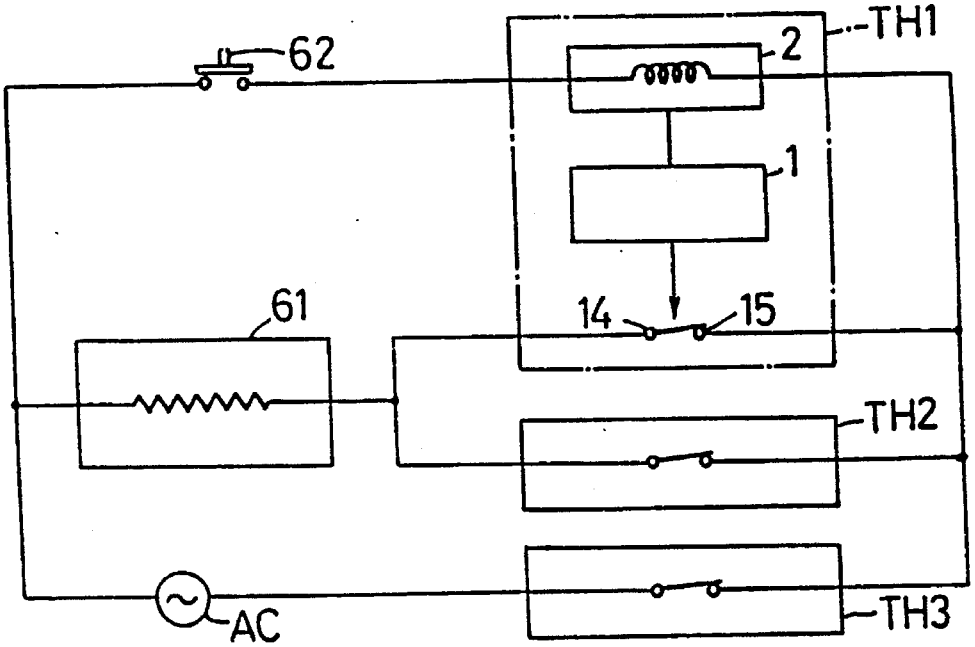
FIG. 17 is a block diagram showing a different heating apparatus using the thermostat of the invention.
Figure 18:
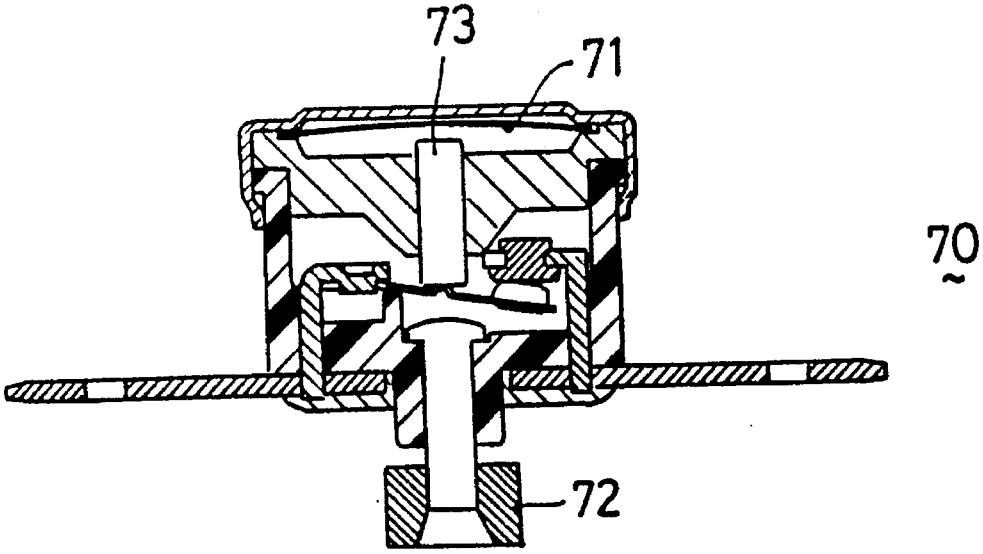
FIG. 18 shows a conventional manual reset type thermostat.
Figure 19:
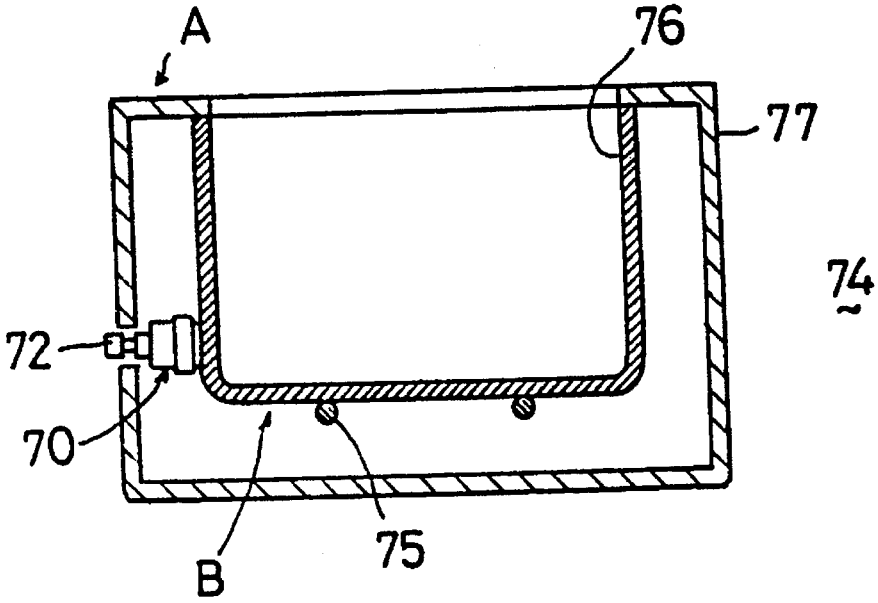
FIG. 19 shows a heating apparatus using the thermostat of FIG. 18.

FIG. 16 and FIG. 17 show a case of applying the thermostat TH for remote control operation shown in FIG. 1 in a boiling type jar pot. This boiling type jar pot is composed of a heater 61 for heating the water contained a pot 60, a thermostat TH1 for remote control operation, a thermostat TH2 for temperature control, a thermostat TH3 for prevention of overheating, a reset button 62 for controlling energization to the forced reset unit 2 of the thermostat TH1 for remote control operation, and an alternating-current power source AC. In the thermostat TH1 for remote control operation, meanwhile, the first set temperature of the heat sensing element is set at 80° C., and the second set temperature, at 50° C. The thermostat TH2 for temperature control is set at the first set temperature of the heat sensing element of 85° C. and the second set temperature of 70° C., and the thermostat TH3 for prevention of overheating, at the first set temperature of the heat sensing element of 120° C. and the second set temperature of −30° C.

In the initial state, all switching contacts of the thermostats TH1, TH2, TH3 are in ON state, and the reset button 62 is in OFF state. In this state, when the power switch (not shown) is turned on by filling the pot 60 with water, the alternating-current power source AC is supplied in the heater 61, and the water in the pot 60 is heated. Consequently, the water temperature in the pot 60 climbs up to reach the first set temperature of 85° C. of the thermostat TH2, when the switching contacts of the thermostat TH2 are changed from ON state to OFF state.

The first set temperature of the thermostat TH1 is 80° C., but since the thermostat TH1 is disposed so as to be operated by the steam temperature in the pot as shown in FIG. 16, if the switching contacts of the thermostat TH2 are changed to OFF state, the switching contacts 14, 15 of the thermostat TH1 remain in ON state, and hence the water in the pot 60 is further heated to reach boiling state.

In the boiling state of the water in the pot, the temperature of the heat sensing element of the thermostat TH1 reaches about 80° C., and hence the heat sensing element of the temperature switch unit 1 is curved to change the switching contacts 14, 15 to OFF state (FIG. 4(*a*)). In this state, since the switching contacts of the thermostat TH2 are already in OFF state, as the switching contacts 14, 15 are changed to OFF state, energization to the heater 61 is stopped, so that the temperature in the pot declines thereafter When the water temperature in the pot drops to about 70° C., the switching contacts of the thermostat TH2 are changed to ON state, and energization to the heater 61 is resumed. When the water temperature in the pot climbs again up to about 85° C., the switching contacts of the thermostat TH2 are changed to OFF state again, and thereafter the same operation is repeated, so that the water temperature in the pot is maintained within about 70° C. to 85° C.

In this way, the water in the pot once brought to a boil is maintained in a range of 70° C. to 85° C., but when the power source is turned off or water is added, the temperature in the pot drops, and the curved state of the heat sensing element of the thermostat TH1 is reset to an upward convex state (FIG. 4(*b*)). As a result, the switching contacts 14, 15 return to ON state, so that the water in the pot 60 is boiled again.

In this way, as the temperature of the heat sensing element of the thermostat TH1 drops below the automatic reset temperature of 50° C., the water in the pot is boiled again, but it may be desired to boil the water in the pot again also in the automatic control state maintained at the water temperature of about 70° C. to 85° C. In such a case, the reset button 62 is turned on, so that the coil of the forced reset unit 2 is energized, and the heat sensing element 2 is reset to initial state by force, and the switching contacts 14, 15 are set in ON state, and the alternating-current power source AC is supplied into the heater 60, thereby heating the water in the pot 60 to be boiled again.

Besides, because of the thermostat TH3 for prevention of overheating, in the event of burning of empty pot 60 or trouble of thermostat TH1 or TH2, when the temperature in the pot reaches about 120° C., heating is stopped by the action of the thermostat TH3.

What is claimed is:

1. A thermostat consecutively comprising a temperature switch unit (1) for varying the opening state of switching contacts (14, 15) by physical dislocation of a heat sensing element (12), and a forced reset unit (2) for resetting the switching contacts (14, 15) by force to the initial state, wherein one of the switching contacts (14, 15) is formed in part of a spring member (9), and between the heat sensing element (12) and spring member (9) is provided a transmission member (11) for transmitting displacement to the spring member, when the heat sensing element is displaced from the initial state, to vary the opening state of the switching contacts, a reset shaft (4) of a proper length for abutting against the spring member is inserted into the temperature switch unit (1) so as to be free to move in back and forth from the opposite side of the heat sensing element, the forced reset unit (2) is provided at least with a bobbin (17) having a central penetration hole, a coil (18) wound on this bobbin, and a magnetic movable member (19) to be inserted into the central penetration hole, and the coil is energized to move the movable member, thereby resetting the switching contacts by force to the initial state.

2. A thermostat of claim 1, wherein the movable member (19) abuts against the reset shaft (4) through a non-magnetic member (20).

3. A thermostat of claim 1, wherein the movable member (19) is thrust in a direction departing from the reset shaft (4) by a spring.

4. A thermostat of claim 1, wherein the reset shaft (4) and movable member (19) are formed into one body.

5. A thermostat of claim 1, wherein between the heat sensing element and the transmission member (11) is disposed a plate member (26) for displacing accordingly when the heat sensing element is displaced from the initial state, and maintaining the displaced state if the heat sensing element is automatically reset to the initial state.

6. A thermostat of claim 1, wherein the switching contacts (14, 15) are composed of spring members for maintaining their open state, and the OFF state is maintained, once the switching contacts (14, 15) are changed to an open state, unless pressed by the reset shaft 94) even after the heat sensing element (24) is automatically reset to the initial state.

7. A thermostat of claim 1, wherein one end (27*a*) of the spring member is formed so as to be stopped in part of the base part (3) of the temperature switch unit (1), or part of the reset shaft (4).

* * * * *